US006647242B2

(12) United States Patent
Gagnon et al.

(10) Patent No.: US 6,647,242 B2
(45) Date of Patent: Nov. 11, 2003

(54) FLEXIBLE CONDUCTIVE PLASTIC STATIC CONTROL DEVICE

(75) Inventors: Daniel F. Gagnon, Westbrook, ME (US); Daniel P. McCormick, Turner, ME (US); Jeffrey W. Richardson, Otisfield, ME (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/017,779

(22) Filed: Dec. 13, 2001

(65) Prior Publication Data

US 2003/0113147 A1 Jun. 19, 2003

(51) Int. Cl.[7] ..... G03G 15/00
(52) U.S. Cl. ..... 399/390; 399/388
(58) Field of Search ..... 399/390, 91, 405, 399/397, 398; 400/624

(56) References Cited

U.S. PATENT DOCUMENTS

| | | | | |
|---|---|---|---|---|
| 4,494,166 A | | 1/1985 | Billings et al. | 361/214 |
| 4,994,861 A | * | 2/1991 | Brandon et al. | 399/315 |
| 5,139,862 A | | 8/1992 | Swift et al. | 428/294 |
| 5,270,106 A | | 12/1993 | Orlowski et al. | 428/295 |
| 5,354,607 A | | 10/1994 | Swift et al. | 428/294 |
| 5,501,899 A | | 3/1996 | Larkin | 428/288 |
| 5,710,692 A | | 1/1998 | Muck et al. | 361/212 |
| 6,048,119 A | | 4/2000 | Kato et al. | 400/624 |

FOREIGN PATENT DOCUMENTS

| | | | |
|---|---|---|---|
| DE | 3418224 | * | 11/1984 |
| JP | 57-62063 | * | 4/1982 |
| JP | 2-168595 | | 6/1990 |
| JP | 3-210797 | | 9/1991 |
| JP | 4-317081 | * | 11/1992 |
| JP | 5-226092 | | 9/1993 |
| JP | 6-36887 | | 2/1994 |
| JP | 6-199010 | | 7/1994 |
| JP | 8-231081 | * | 9/1996 |
| JP | 9-63786 | * | 3/1997 |
| JP | 10-125490 | * | 5/1998 |
| JP | 10-166299 | * | 6/1998 |
| JP | 10-302993 | * | 11/1998 |

* cited by examiner

*Primary Examiner*—Quana M. Grainger
(74) *Attorney, Agent, or Firm*—Mark W. Croll; Paul F. Donovan

(57) ABSTRACT

A static control device suitable for printers, copiers and the like is disclosed. A carrier strip of non-metallic electrically conductive material, such as plastic, is provided with a plurality of spaced bundles of electrically conductive filaments. The bundles extend beyond the carrier strip, in close proximity to media transported along a media path in the media handling apparatus. In the presence of electrical fields, the filaments induce ionization, and establish a conductive path for charges on the media to the carrier strip for grounding.

16 Claims, 2 Drawing Sheets

FLEXIBLE CONDUCTIVE PLASTIC STATIC CONTROL DEVICE

FIELD OF THE INVENTION

The present invention relates to static control devices in media handling systems, such as printers and copiers; and, more specifically, to static control devices utilizing fine fiber bundles and non-contact ionization for static charge dissipation.

BACKGROUND OF THE INVENTION

In a commonly used process for electrophotographic printing applications, such as for printers and copiers, a uniform charge is applied to a photoconductive surface on a drum or belt. A light beam, such as from a laser, is used to expose the surface, leaving an electrostatic latent image corresponding to the image to be printed. The latent image is developed by the application of toner particles that adhere to the electrostatic latent image. The toner image is transferred to the media intended to receive the printed image, and is fixed thereon through the application of heat and/or pressure in a fuser.

In a sheet handling device such as a printer or copier, and other machines having sheet handling pathways, electrical charges can build up in media, such as paper, that is transported through the machine. The media transported through such a device, both before and after reception thereon of the toner image, is frictionally contacted by numerous rotating members, and is slid along, over and against various stationary guide members. Consequently, the media can accumulate both positive and negative electric charges, both as a result of transport through the machine and from transfer of chargers from the photoconductive process. Paper will typically accept and hold such charges readily.

Buildup of charges on the media can impact machine performance and function detrimentally. Charges on the media can cause the media to be attracted to or repelled from transport surfaces, interfering with proper transport and indexing of the media for proper printing. Charges in the media also can interfere with transfer of the toner image to the media surface, by attracting stray toner particles thereto, in areas of the sheet not intended to receive a toner image. Such charges also can cause sheets to adhere to each other, causing media jams in the machine.

Thus, it is desirable to remove the electrostatic charges from the sheet. Early attempts at controlling static charges included devices to ionize air surrounding the sheet, thereby providing a pathway to ground. It was also known to contact the sheet directly with conductive strips, providing a more physically continuous grounding path for charges on the sheet. Early ionizing devices were expensive and produced ozone, and contacting devices sliding over a newly formed image as the sheet is transported through the machine degraded the image quality. Thus, neither of these attempts was completely satisfactory.

It also is known to contact the sheet with conductive brushes having fibers secured in a matrix. For example, it is known from U.S. Pat. No. 5,354,607 "FIBRILLATED PULTRUDED ELECTRONIC COMPONENT STATIC ELIMINATOR DEVICES" to form pultrusions from densely packed bundles of fibers. One end of the bundle is fibrillated, and the exposed ends thereof contact a surface to be discharged. Other types of both contacting and non-contacting brush-like static charge eliminators are also known.

In another known, brush-like static eliminator, a thin tape of aluminum foil is provided transverse to the paper path in a machine. A plurality of discrete bundles of individual electrically conductive fibers are adhered to the aluminum foil, and can contact or come in close proximity to the surface of a sheet transported along the path. A problem with this design is that aluminum foil can tear easily, and is difficult to apply on a machine in a straight line, which is necessary to maintain constant space from a sheet along the length of the device. It is also known to use an aluminum strip rather than foil. However, the aluminum strip has physical memory, and will tend to curve at the ends thereof, if the aluminum strip was ever provided or stored in a roll. Also, aluminum is subject to oxidation, which reduces the conductivity and increases the surface resistance. If oxidation is significant, the effectiveness of the static control device can be diminished.

Attempts at improving such devices have not met with total success. Using a non-conductor, such as polyester, in the support or carrier strip may eliminate memory problems, but requires incorporation of conductive structures for connecting the fiber bundles to a grounding source. A single fiber or a plurality of fibers running the length of the strip can be used as the conductive structure, but is subject to failure if the continuity thereof is broken. Providing a metal coating on a non-conductive base material to serve as the conductive structure is also effective electrically, but again scratching can cause discontinuity and failure of the device.

What is needed in the art is a rigidly backed static eliminator that has bulk conductivity and corrosion resistance, and facilitates straight installation of the device in a printer, copier or the like.

SUMMARY OF THE INVENTION

In one aspect thereof, the present invention provides a static control device with a carrier strip of non-metallic, electrically conductive material. The strip has a length and first and second lateral edges extending along the length. At least one bundle of electrically conductive filaments is attached to the carrier strip, disposed on the strip transverse to the lateral edges and extending beyond at least one of the lateral edges.

In another aspect thereof, the present invention provides a static control system for a media handling apparatus having frame members and conveying devices providing a media path for transporting sheets of media through the apparatus along the media path. A static control device includes a non-metallic conductive carrier strip. The carrier strip has a length and first and second lateral edges. The carrier strip is attached and electrically connected to the frame. At least one bundle of electrically conductive filaments is attached to the carrier strip, the at least one bundle of filaments being disposed on the strip transverse to the lateral edges, and extending beyond at least one of the lateral edges.

In yet another aspect thereof, the present invention provides a static control system for a media handling apparatus with at least one frame member and conveying devices providing a media path for transporting sheets of media through the apparatus along the media path. A static control device includes a flexible, conductive plastic carrier strip, the carrier strip having a length and first and second lateral edges. The carrier strip is attached and electrically connected to the frame, and disposed transverse to media transported along the media path. A plurality of bundles of electrically conductive filaments are attached to the carrier strip, and disposed on the strip transverse to the lateral edges. The filaments have ends disposed in spaced relation to media transported along the media path.

An advantage of the present invention is providing a static control device that is easy to install properly, and that is resistant to corrosion, staining and physical deterioration from contact with common cleaning materials.

Another advantage of the present invention is providing a static control device that is robust, and can withstand a degree of physical damage without compromising its operational effectiveness.

Yet another advantage of the present invention is to provide a static control device that is light weight to reduce shipping expense, has low physical memory to remain flat when installed even if it was previously stored in a roll, and that has smooth edges for increased safety in handling.

Other features and advantages of the invention will become apparent to those skilled in the art upon review of the following detailed description, claims and drawings in which like numerals are used to designate like features.

Figure 1:
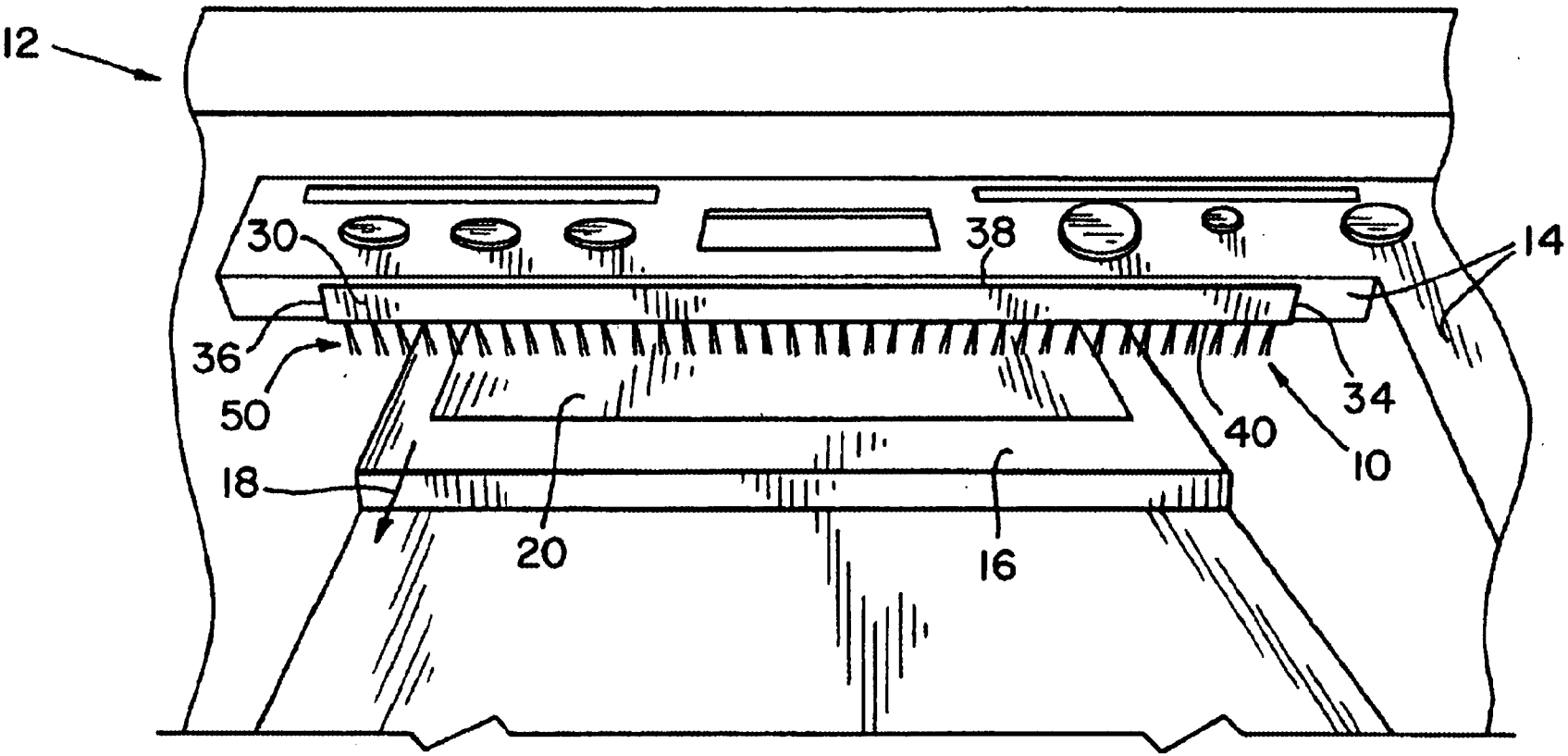
FIG. 1 is a fragmentary perspective view of a printer having a flexible conductive plastic static control device of the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof, as well as additional items and equivalents thereof.

DETAILED DESCRIPTION OF THE PREFERRED EMBODIMENT

Referring now more specifically to the drawings, and to FIG. 1 in particular, numeral 10 designates a static control device of the present invention provided in a media handling apparatus 12. Apparatus 12 may be a copier, printer, scanner or other device processing sheets of media, such as paper, for printing or scanning functions. As illustrated in FIG. 1, apparatus 12 is a printer. Static control device 10 operates advantageously in all types of printers, and is particularly advantageous in printers employing electrophotographic printing processes.

Apparatus 12 includes a plurality of frame members 14, conveying devices 16 and other structural members defining a media path 18 along which individual sheets of media 20, such as paper, are transported during the printing process. Static control device 10 is positioned relative to media transported along media path 18 to dissipate either positive or negative electrical charges that may have accumulated on the media. Static control device 10 is attached to a frame member 14 and is positioned transverse to the direction of travel of media along media path 18.

Figure 2:
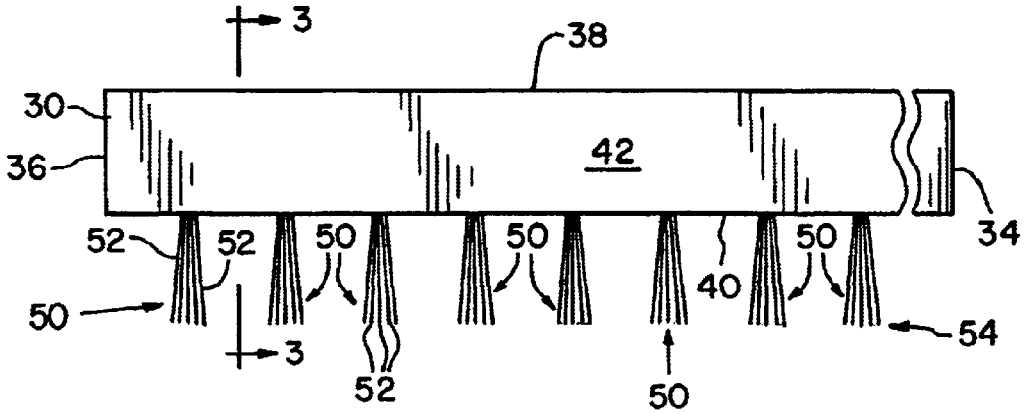
FIG. 2 is an elevational view of a first side of a segment of the static control device.
Figure 4:
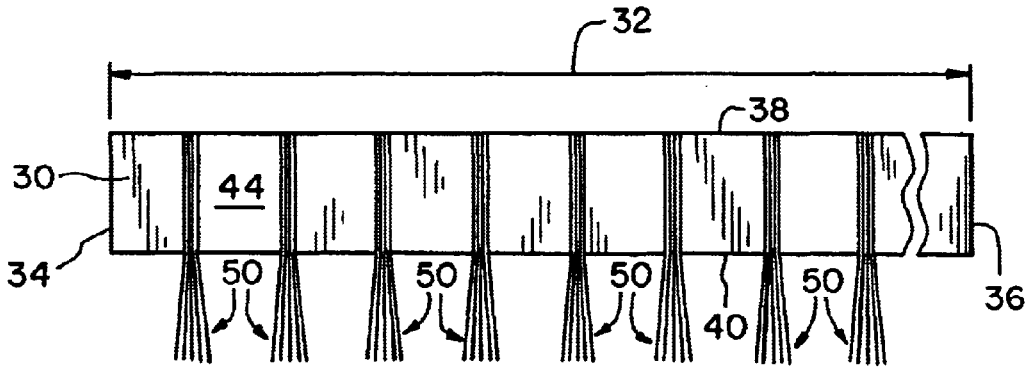
FIG. 4 is cross sectional view of the segment of the static control device shown in FIG. 3, taken along line 4—4 of FIG. 3.

With reference now to FIG. 2, static control device 10 includes a carrier strip 30, a segment of which is shown in FIGS. 2 and 4. Carrier strip 30 is an elongated body having a length indicated by line 32 in FIG. 4, between ends 34 and 36. Lateral edges 38 and 40 extend along length 32, from end 34 to end 36. As illustrated in FIG. 2, carrier strip 30 has a front surface 42, and, as illustrated in FIG. 4, a back surface 44. Carrier strip 30 is a flexible body of non-metallic conductive material such as conductive plastic. Polycarbonate film is a suitable material for carrier strip 30, and one such epolycarbonate marketed under the trade name BAYFOL® is available from Bayer Polymers Division, Bayer Corporation, 100 Bayer Road, Pittsburgh, Pa. 15205-9741. BAYFOL® AS-A film is an extruded anti-static film made from a blend of polycarbonate and polyester. A carbon black filler is included in the structure to provide anti-static properties. Suitable material must provide acceptable surface and volume resistivity and heat resistance. Carrier strip 30 is sufficiently flexible to accommodate various surface irregularities but has sufficient stiffness in the transverse direction from lateral edge 38 to lateral edge 40 to facilitate straight line application of carrier strip 30 to frame member 14.

A plurality of bundles 50, each having a plurality of filaments 52, is provided along carrier strip length 32. Filaments 52 can be carbon fiber, stainless steel fiber, conductive acrylic fiber or any conductive fiber type filament that can be provided with diameters sufficiently small to induce ionization when in the presence of an electrical field. Filaments 52 are very fine hair-like structures. In FIGS. 2 and 4, for ease in illustration, each bundle 50 is shown to have 5 filaments 52. However, it should be recognized that in most applications for static control device 10, each bundle 50 will include many more than 5 filaments, and may include 50 or more filaments 52. Each filament 52 of bundles 50 is adhered directly or indirectly to carrier strip 30 in electrically conductive connection. As seen in FIGS. 2 and 4, bundles 50 are secured to back surface 44 of carrier strip 30, and filaments 52 thereof each have a distal end 54 that extends substantially beyond lateral edge 40 of carrier strip 30.

Figure 3:
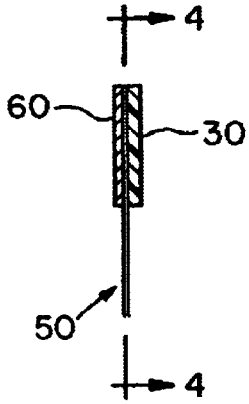
FIG. 3 is cross sectional view of the segment of the static control device shown in FIG. 2, taken along line 3—3 of FIG. 2.

Back surface 44 of carrier strip 30 and those portions of bundles 50 on back surface 44 are covered with a suitable contact adhesive 60 (FIG. 3). Contact adhesive 60 should be electrically conductive, to establish an electrical connection between carrier strip 30 and frame member 14 on which static control device 10 is installed. During transport and handling of static control device 10, a holder layer (not shown) of release material is provided to retain thereon carrier strip 30 and to protect filament bundles 50. Several lengths of static control devices 10 can be provided on a single holder layer, which should be of sufficient width to accommodate the width of carrier strip 30 and the length of fiber bundles 50 extending beyond carrier strip 30. Adhesive 60 releases from the holder layer, and is used to secure static control device 10 to frame member 14.

Filament bundles 50 and individual filaments 52 thereof are similar to filaments and bundles used in previous static control devices using aluminum strip material as the carrier piece. However, unlike aluminum strips, the conductive plastics of the present invention do not posses physical memory sufficient to cause curling of the ends 34 and 36, even if carrier strip 30 is supplied or stored in rolls. Further, the conductive plastic of carrier strip 30 is not subject to oxidation, and the functional properties of carrier strip 30 do not degrade from oxidation. Water and other common cleaning materials used for printers, copiers and the like do not adversely impact carrier strip 30. Since the conductivity of carrier strip 30 is consistent throughout its length, width, and thickness scratches or other mars on front surface 42 or back surface 44 do not adversely affect the conductivity of carrier strip 30 significantly. Carrier strip 30 is light-weight, reducing expense for shipping. Further, as compared with prior structures employing metallic strips, carrier strip 30 of the present invention is smooth and has soft edges, eliminating potential cuts or scratches to assemblers handling the carrier strip. Carrier strip 30 is also resistant to staining and other corrosion from common cleaners that may be used and from moist environments in which the media handling apparatus 12 may be installed. The flexibility of the conductive plastic allows strip 30 to follow the contour of the surface on frame member 14, thereby providing excellent conductivity from filaments 52 to carrier strip 30 and to frame member 14 through which grounding occurs. The rigidity of carrier strip 30 particularly between lateral edges 38 and 40 facilitates alignment of carrier strip 30 in device 10, and application in a desired straight line, particularly as compared with aluminum foils and fiber cloth products used in prior static control devices.

In the use and operation of static control device 10 according to the present invention, carrier strip 30 is obtained in sufficient length 32 to extend across the width of media path 18. Length 32 can be cut from a longer supply of static control device 10, which may be provided in a roll or coil. Lateral edge 40 is positioned parallel to media path 18, such that ends 54 of filaments 52 are spaced appropriately from media sheet 20 being transported along media path 18. Frame member 14 is provided along media path 18 and carrier strip 30 is attached to frame member 14 by proper positioning of carrier strip 30 and application of pressure with adhesive 60 against frame member 14. Carrier strip 30 is thereby adhered to frame member 14 in electrically conductive fashion such that electrical chargers received by carrier strip 30 are transmitted to frame 14 and the grounding path of media handling apparatus 12. Bundles 50 are positioned in close proximity to, but need not contact media transported along media path 18, as those skilled in the art will understand readily. As an electrical field generated by charges contained on the media sheets pass along path 18 encounter filaments 52, an ionized field is created, allowing the transfer of charges from the media sheet to bundles 50 and carrier strip 30. As a result of the electrically conductive path created by adhesive 60 and between carrier strip 30 and frame member 14 positive and negative charges are conducted to ground through the grounding circuit of media handling apparatus 12.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A static control device comprising:

a carrier strip of flexible, non-metallic, electrically conductive material, said strip having a length and first and second lateral edges extending along said length, said strip having a front surface and a back surface extending between said edges, and said strip being flexible in a direction between said surfaces and being resistive to bending in a transverse direction defined between said lateral edges; and at least one bundle of electrically conductive filaments attached to and along said back surface of said carrier strip with an adhesive layer placed on said back surface of said carrier strip, said at least one bundle of filaments disposed on said strip transverse to said lateral edges and extending beyond at least one of said lateral edges, and said adhesive layer being adapted to attach said carrier strip to a frame member.

2. The static control device of claim 1, said carrier strip being plastic.

3. The static control device of claim 2, wherein said adhesive layer is electrically conductive.

4. The static control device of claim 2, said carrier strip being polycarbonate.

5. The static control device of claim 2, said filaments selected from the group consisting of fibers of carbon, stainless steel and conductive acrylics.

6. The static control device of claim 2, including a plurality of bundles of electrically conductive filaments spaced along said length of said carrier strip.

7. A static control device comprising:

a carrier strip of flexible, non-metallic, electrically conductive material, said strip having a length and first and second lateral edges extending along said length, said strip having a front surface and a back surface and being flexible in a direction between said surfaces and being resistive to bending in a transverse direction defined between said lateral edges; and at least one bundle of electrically conductive filaments attached to said back surface of said carrier strip with an adhesive layer placed on said back surface of said carrier strip, said at least one bundle of filaments disposed on said strip transverse to said lateral edges and extending beyond at least one of said lateral edges, and said adhesive layer being adapted to attach said carrier strip to a frame member, wherein said adhesive layer is electrically conductive.

8. A static control system for a media handling apparatus comprising:

frame members and conveying devices providing a media path for transporting sheets of media through the apparatus along said media path; and a static control device including;

a non-metallic conductive carrier strip, said carrier strip having a length and first and second lateral edges, said carrier strip being attached and electrically connected to at least one of said frame members; and at least one bundle of electrically conductive filaments attached to said carrier strip, said at least one bundle of filaments disposed on said strip transverse to said lateral edges, and extending beyond at least one of said lateral edges, said at least one bundle of electrically conductive filaments being spaced from media transported along said media path.

9. The static control system of claim 8, said strip disposed transverse to the travel of media transported along said media path.

10. The static control system of claim 8, said carrier strip being conductive plastic.

11. The static control system of claim 10, said plastic being flexible.

12. The static control system of claim 8, including an adhesive holding said strip on said frame.

13. The static control system of claim 8, including a plurality of bundles of electrically conductive filaments spaced along said carrier strip, and each bundle of electrically conductive filaments extending beyond a lateral edge of said strip.

14. A static control system for a media handling apparatus comprising:

at least one frame member and conveying devices providing a media path for transporting sheets of media through the apparatus along said media path; and a static control device including;

a flexible, conductive plastic carrier strip, said carrier strip having a length and first and second lateral edges extending along said length, said carrier strip being attached and electrically connected to at least one of said frame members, and disposed transverse to media transported along said media path, said strip having a front surface and a back surface and being flexible in a direction between said surfaces and being resistive to bending in a transverse direction defined between said lateral edges; and a plurality of bundles of electrically conductive filaments attached to said carrier strip, said plurality of bundles of filaments disposed on said strip transverse to said lateral edges, and extending beyond at least one of said lateral edges, toward said media path, said filaments having diameters sufficiently small to induce ionization in the presence of an electrical field, and having distal ends remote from said carrier strip disposed in spaced relation to media transported along said media path.

15. The static control system of claim 14, including adhesive attaching said carrier strip to said frame member.

16. The static control system of claim 14, said flexible, conductive plastic carrier strip being a polycarbonate.

* * * * *